US006886461B2

(12) United States Patent
Bolza-Schünemann

(10) Patent No.: US 6,886,461 B2
(45) Date of Patent: May 3, 2005

(54) SHORT INKING SYSTEM FOR A ROTARY PRINTING MACHINE

(75) Inventor: Hans-Bernhard Bolza-Schünemann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/275,278

(22) PCT Filed: May 12, 2001

(86) PCT No.: PCT/DE01/01816

§ 371 (c)(1),
(2), (4) Date: May 2, 2003

(87) PCT Pub. No.: WO01/87036

PCT Pub. Date: Nov. 22, 2001

(65) Prior Publication Data

US 2003/0172824 A1 Sep. 18, 2003

(30) Foreign Application Priority Data

May 17, 2000 (DE) ..... 100 23 935

(51) Int. Cl.[7] ..... B41F 31/14

(52) U.S. Cl. ..... 101/352.06; 101/350.3; 101/352.13

(58) Field of Search ..... 101/150, 153, 101/154, 350.1, 350.3, 350.6, 352.06, 352.4, 352.13, DIG. 38

(56) References Cited

U.S. PATENT DOCUMENTS

| | | | | | |
|---|---|---|---|---|---|
| 3,585,932 | A | * | 6/1971 | Granger | 101/351.7 |
| 3,916,791 | A | * | 11/1975 | Simeth | 101/141 |
| 3,983,812 | A | * | 10/1976 | Schramm | 101/350.3 |
| 4,332,195 | A | | 6/1982 | Mizumura | |
| 4,488,485 | A | | 12/1984 | Bolza-Schunemann | |
| 4,782,753 | A | * | 11/1988 | Bolza-Schunemann | 101/363 |
| 4,903,599 | A | * | 2/1990 | Kubler et al. | 101/450.1 |
| 5,119,726 | A | | 6/1992 | Dorsam | |
| 5,341,733 | A | | 8/1994 | Weisbrod | |
| 5,909,708 | A | | 6/1999 | Bolza-Schunemann | |
| 6,020,108 | A | * | 2/2000 | Goffing et al. | 430/306 |
| 6,050,188 | A | | 4/2000 | Bolza-Schunemann | |
| 6,062,136 | A | | 5/2000 | Bolza-Schunemann | |
| 6,213,018 | B1 | * | 4/2001 | Samworth | 101/395 |
| 6,289,807 | B1 | * | 9/2001 | Kutzner et al. | 101/350.1 |
| 6,349,643 | B1 | * | 2/2002 | Loftus et al. | 101/351.1 |
| 6,418,846 | B1 | * | 7/2002 | Hoier | 101/216 |

FOREIGN PATENT DOCUMENTS

| | | |
|---|---|---|
| CA | 1 165 176 | 4/1984 |
| DE | 85 33 004.3 | 6/1988 |
| DE | 32 20 926 C2 | 1/1990 |
| DE | 195 38 546 A1 | 1/1997 |
| DE | 195 35 266 A1 | 4/1997 |
| EP | 0 017 844 A1 | 10/1980 |
| EP | 0 028 421 A1 | 5/1981 |
| EP | 0 418 778 A2 | 3/1991 |
| EP | 0 653 302 A1 | 5/1995 |
| EP | 0 764 524 A2 | 3/1997 |
| EP | 0 951 995 A1 | 10/1999 |
| EP | 0 983 850 A2 | 3/2000 |
| WO | WO 91/13761 | 9/1991 |
| WO | WO 97/02143 | 1/1997 |

* cited by examiner

*Primary Examiner*—Andrew H. Hirshfeld
*Assistant Examiner*—Leo T. Hinze
(74) *Attorney, Agent, or Firm*—Jones Tullar & Cooper PC

(57) ABSTRACT

A short inking unit for a rotary printing machine is provided. The short inking unit includes a changeable machine glazing cylinder.

61 Claims, 2 Drawing Sheets

SHORT INKING SYSTEM FOR A ROTARY PRINTING MACHINE

FIELD OF THE INVENTION

The present invention is directed to a short inking system of a rotary printing press. The present invention is also directed to a method for using a short inking system.

BACKGROUND OF THE INVENTION

WO 91/13761 A1 describes a short inking system of a rotary printing press in which the forme cylinder and the ink application roller have the same diameter. A traversing smoothing roller is assigned to the ink application roller.

U.S. Pat. No. 4,332,195 discloses an inking system with a screen roller, in which an axially movable smoothing cylinder is provided. The smoothing cylinder and the ink application rollers have different diameters.

EP 0 418 778 A2 shows an inking system with axially movable ink application rollers. The ratio of the diameters of the ink application rollers and forme cylinders is not discussed.

SUMMARY OF THE INVENTION

The object of the present invention is directed to providing a short inking system for a rotary printing press.

In accordance with the present invention, the object is attained by providing a short inking system of a rotary printing press having an anilox or screen roller and at least one cooperating ink application roller which inks a forme cylinder. The circumference of the forme cylinder may be a whole number multiple of the ink application roller. The ink application roller may move axially with respect to the forme cylinder. Alternatively, a smoothing cylinder, whose diameter is the same as the ink application roller, may moved axially. A separate drive may be provided for the ink application roller or the smoothing cylinder.

This short inking system, without duct-adjusting screws, is preferably arranged in offset printing presses for quality job printing.

Short inking systems are generally known. They are typically embodied as dual rollers with an anilox roller and an application roller. They are sufficient for good newspaper quality. To provide jobbing quality on coated paper, using a fine seventy line raster image plate, for example, anilox rollers, with comparatively finer engraving than the anilox rollers typically used for newspaper printing, are required in order to avoid moiré effects. However, anilox rollers of that type, with finer engraving, are sensitive to mechanical damage.

In accordance with the present invention, a coarser, and thus a mechanically more stable, structure of the anilox roller can also be used for fine line raster image plates if the ink film generated by a such a coarse anilox or screen roller is smoothed on the application roller before the fine line raster image plate is touched.

Smoothing rollers with lateral distribution are known, per se, for use with classical inking systems. However, their diameter is kept small, they perform more than one revolution per length of print and they reverse on the plate or forme with their reversing points having a lateral distribution.

This use of smoothing rollers therefore results in stenciling, ink accumulations, in particular also from the print conduit of web-fed printing presses, and in a decrease in inking across the length of the circumference toward the end of printing.

It is proposed in accordance withe the present invention, and in a new and unique way to use only a single smoothing cylinder, which rotates at a ratio of 1:1 with the forme cylinder and which can therefore not stencil on the circumference of the plate or forme.

Falling of the smoothing cylinder into the application roller trough or groove is prevented by bearer rings, and stopping of the smoothing cylinder in the application roller trough or groove is prevented by a gear wheel drive. With an endless vulcanized 1:1 application roller, the bearer rings and the gear wheel drive of the smoothing cylinder can be omitted. However, the greatest imprint quality can be achieved by the use of offset print blankets as the ink transfer medium on the application roller cylinder, which use of such offset print blankets requires a clamping groove or a vulcanized rubber blanket cylinder sleeve.

The smoothing cylinder is moved back and forth only once over two of its revolutions. During its first revolution, the smoothing cylinder performs a forward or axial movement, in a first axial direction, over the entire print development length, of approximately 15 to 20 mm. The reversal of movement direction takes place with the surface of the smoothing cylinder lying in the cylinder groove of the application roller. During its second revolution, the smoothing cylinder travels back again, in a reverse axial direction, over the entire print development length, without a movement direction reversal. Reversal of the axial movement direction again takes place while the smoothing cylinder is aligned with the cylinder trough or groove of the application roller. It is assured, in this way, that no differences in ink color, because of stopping or because of movement direction reversal of the smoothing cylinder on the application roller, the plate, and therefore in the print image on the paper, become visible.

In every case, the axial lift or the axial displacement of the smoothing cylinder must be sufficiently large so that a distance of more than one cup, or of the line resolution distance between more than one hachure or line of engraving, on the anilox or screen roller is laterally distributed in the contact strip between the smoothing cylinder and the ink application roller.

The three roller inking system, a dual roller inking system with an additional 1:1-size smoothing roller, provides inking, which is free of stencils, to extremely difficult printing formes, along with satisfactory ink density over the width and the circumference of the printing formes on the forme cylinder.

In a further development of the present invention, the ink application roller can also work, together with a double-size plate cylinder, for two different ink plates on the circumference, for example, and therefore with a cylinder ratio of plate cylinder to ink application roller of 2:1 and more. In that case, the application roller must be clocked or timed in order to only ink its ink plate while it continues to remain in contact with the anilox or screen roller. In this case, the smoothing cylinder must follow the small position change of the application roller, i.e. the bearer ring is preserved by suitable means.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
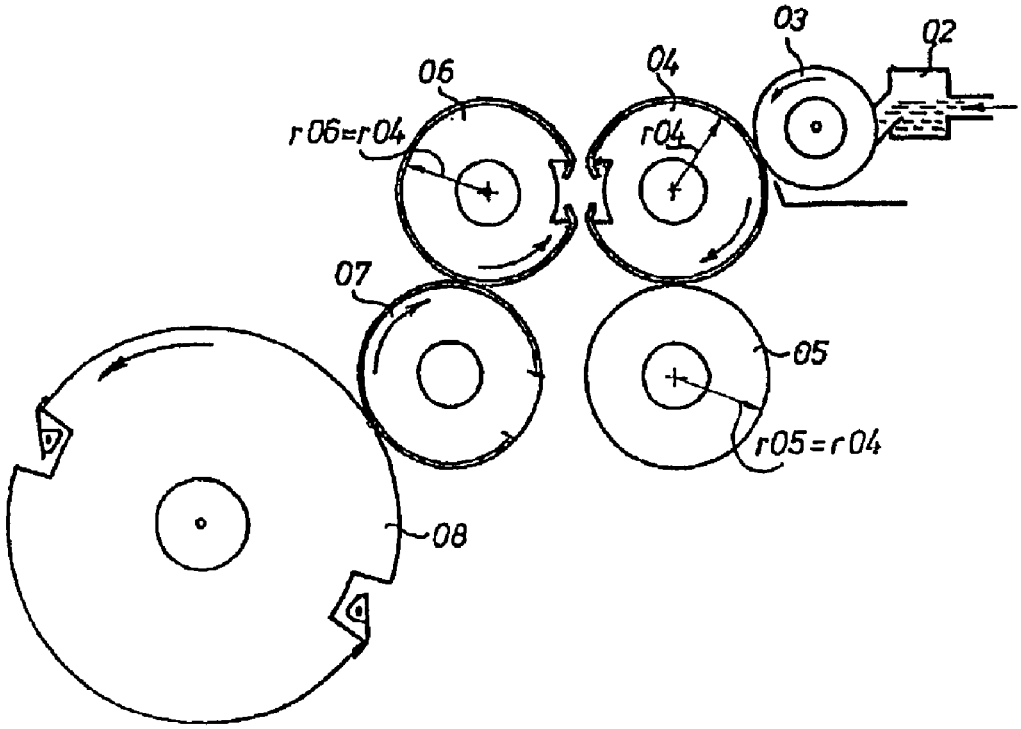
FIG. 1, a schematic representation of a print unit with a printing forme on the circumference of the forme cylinder in accordance with the present invention, and in FIG. 2, a schematic representation of a printing press, in which each forme cylinder has two printing formes, each of which is inked by an inking system.

An inking system of a rotary printing press, preferably an offset rotary printing press, and as shown in FIG. 1, substantially has a screen roller or anilox roller 03, a first inking roller 04, for example an ink application roller 04, as well as a further inking roller 05, for example a smoothing cylinder 05. For supplying ink to the anilox or screen roller 03, a doctor blade device 02, for example a chamber doctor blade 02, is assigned to the anilox or screen roller 03. Preferably the ink is pasty and has a viscosity greater than 9000 mPa.s.

The ink application roller 04 inks a printing forme, for example the printing plate of a forme cylinder 06, for example a plate cylinder 06.

This forme cylinder 06 works together with a transfer cylinder 07, for example a rubber blanket cylinder 07. Together with a counter-pressure cylinder 08, this transfer cylinder 07 constitutes a printing location. The counter-pressure cylinder 08 can be embodied as a "hard" counter-pressure cylinder 08, for example with holding elements, or as a second transfer cylinder. An inking system can be assigned to the forme cylinder 06, in which case the radius r04 of the ink application roller 04 is identical to the radius r06 of the forme cylinder 06.

Figure 2:
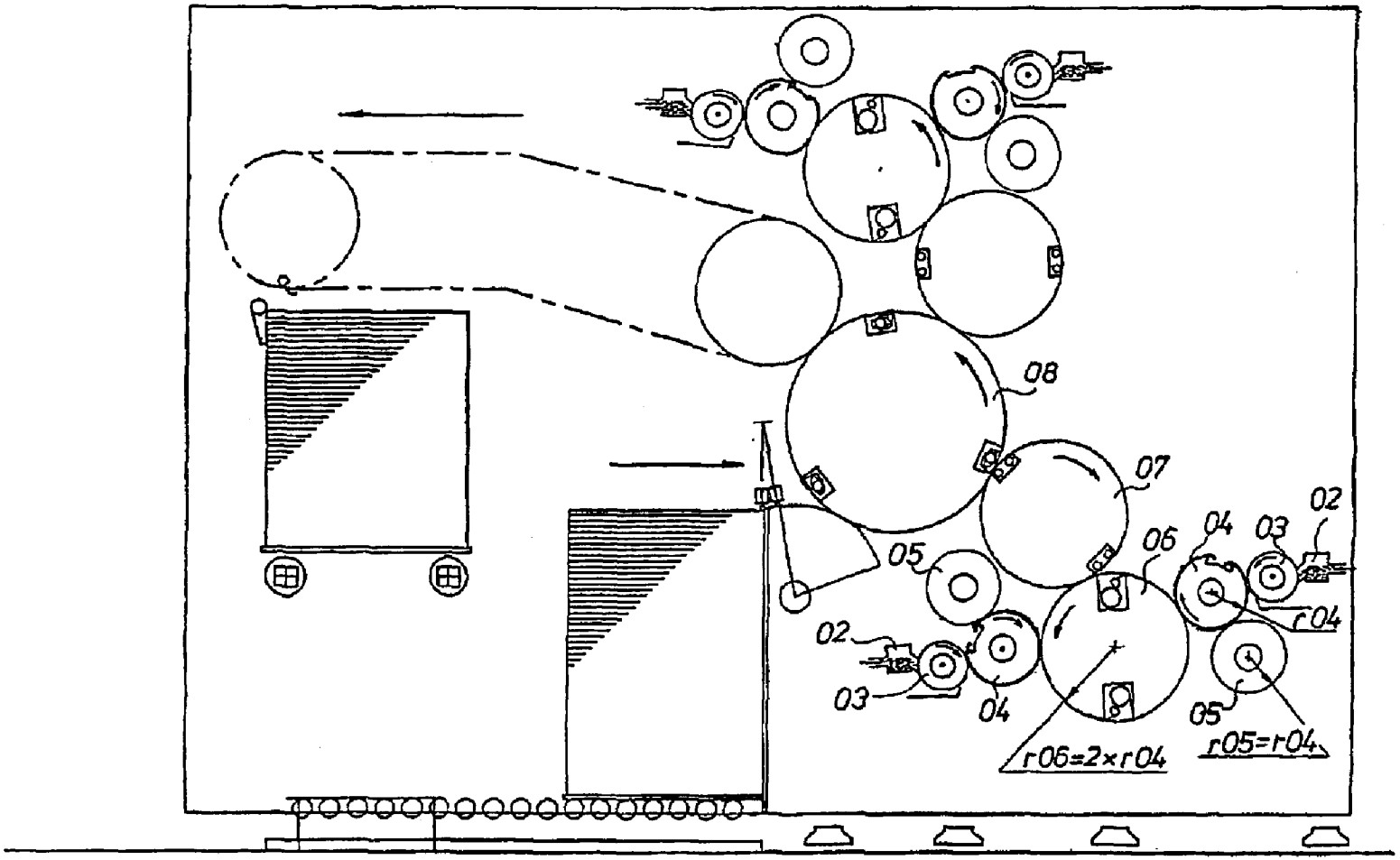

If, as depicted in FIG. 2, several, for example two, inking systems are assigned to the forme cylinder 06, the number of inking systems assigned to the forme cylinder 06 is equal to a whole number multiple of the ratio of the radius r06 of the forme cylinder 06 to the radius r04 of the ink application roller 04. In this depicted configuration shown in FIG. 2, the radius r06 of the forme cylinder 06 is twice the radius r04 of the ink application roller 04 since two inking systems are assigned to the forme cylinder 06.

The ink application roller 04 preferably contacts the forme cylinder 06, as well as the anilox or screen roller 03. However, several inking rollers or ink application rollers 04 of the same size may be positioned between the anilox or screen roller 03 and the forme cylinder 06.

A further or an additional ink application roller 05, for example a smoothing roller 05, is assigned to each such ink application roller 04.

The ink application roller 04 and/or the smoothing cylinder 05 perform a lift or a displacement or movement in the axial direction.

The smoothing cylinder 05 preferably performs traversing movements, and the ink application roller 04 is preferably fixed in the axial direction.

A ratio of a line spacing or resolution of the anilox or screen roller 03 to an image raster or resolution of the printing forme of the forme cylinder 06 is greater than 0.5, in particular greater than 0.8.

While preferred embodiments of a short inking system for a rotary printing machine in accordance with the present invention have been set forth fully and completely hereinabove, it will be apparent to one of skill in the art that a number of changes could be made without departing from the true spirit and scope of the present invention which is accordingly to be limited only by the following claims.

What is claimed is:

1. A short inking system of a rotary printing press comprising:

a first short inking unit including a first screen roller, having a first screen roller diameter and circumference;

a first ink application roller in contact with said first screen roller and having a first ink application roller diameter and circumference;

a second short inking unit including a second screen roller having a second screen roller diameter and circumference;

a second ink application roller in contact with said second screen roller and having a second ink application roller diameter and circumference;

a forme cylinder which receives ink from said first and second ink application rollers, said forme cylinder having a forme cylinder circumference, said forme cylinder circumference being twice said first and second ink application roller circumference;

first and second printing formes on said forme cylinder;

a first, axially movable smoothing cylinder in engagement with said first ink application roller and having a first smoothing cylinder diameter equal to said first ink application roller diameter, and a first smoothing cylinder circumference, said forme cylinder circumference being twice said first smoothing cylinder circumference; and a second axially movable smoothing cylinder in engagement with said second ink application roller and having a second smoothing cylinder diameter equal to said second ink application roller diameter, and a second smoothing cylinder circumference, said forme cylinder circumference being twice said second smoothing cylinder circumference.

2. The short inking system of claim 1 further including a number of said short inking units associated with said forme cylinder, said number of said short inking units equaling a whole number multiple which said forme cylinder circumference is in relation to said at least first ink application roller circumference.

3. The short inking system of claim 1 wherein said at least one ink application roller has an offset rubber blanket.

4. The short inking system of claim 1 wherein said ink application rollers, said smoothing cylinders, said screen rollers and said forme cylinder are synchronized by gear wheels.

5. The short inking system of claim 1 further including bearer rings for said first and second ink application rollers and said first and second screen rollers.

6. The short inking system of claim 1 wherein each said ink application roller and each said screen roller have bearer rings acting together in pairs.

7. The short inking system of claim 1 further including a transfer cylinder acting with said forme cylinder.

8. The short inking system of claim 7 wherein said transfer cylinder and said forme cylinder have bearer rings acting together in pairs and further wherein said ink application roller and said screen rollers have bearer rings acting in pairs.

9. The short inking system of claim 7 wherein said transfer cylinder and said forme cylinder have pretensioned roller bearings acting together in pairs and further wherein each said ink application roller and each said screen roller have pretensioned roller bearings acting in pairs.

10. The short inking system of claim 1 further including pretensioned rolling bearings for said ink application roller and said screen roller.

11. The short inking system of claim 1 wherein said ink application roller and said screen roller have roller bearings acting together in pairs.

12. The short inking system of claim 1 further including a functionally endless blanket on said at least one ink application roller.

13. The short inking system of claim 1 further including a chamber doctor blade associated with said screen roller.

14. The short inking system of claim 1 wherein a ratio of a screen on said screen roller to a ratio of a screen on a printing forme on said forme cylinder is greater than 0.8.

15. The short inking system of claim 1 further wherein a ratio of a circumferential displacement per angular unit of each said smoothing roller to an axial displacement per angular unit of each said smoothing roller is between 2.5 and 5.

16. A method of using an inking system of a rotary printing press including:

providing a screen roller having a screen roller diameter and circumference;

providing said screen roller circumference having a screen roller resolution;

providing printing ink of a viscosity of at least 9000 mPa.s to said screen roller;

providing at least first and second inking rollers;

having one of said first and second inking rollers acting as an ink application roller and having an ink application roller circumference;

having the other of said first and second inking rollers acting as an ink smoothing cylinder contacting said ink applicator roller;

providing a forme cylinder having a forme cylinder circumference;

selecting said forme cylinder circumference as a whole number multiple of said ink application roller circumference;

using said ink application roller for inking said forme cylinder;

supporting one of said ink application roller and said ink smoothing cylinder for movement in an axial direction;

moving said axially movable one of said ink application roller and said ink smoothing cylinder in a first axial movement direction during one printing movement of said forme cylinder;

reversing said movement direction while said axially movable one of said ink application roller and said ink smoothing cylinder is aligned with a cylinder trough of a cooperating one of said ink forme cylinder and said other of said first and second inking rollers;

providing at least one image on said forme cylinder and having an image resolution; and selecting said screen roller resolution and said forme cylinder resolution wherein a ratio of said screen roller resolution to said image resolution is greater than 0.5.

17. The method of claim 16 further including providing a second ink application roller.

18. The method of claim 17 further including providing said second ink application roller as is a smoothing cylinder supported for axial movement.

19. The method of claim 18 further including providing said forme cylinder, said ink application roller and said smoothing roller having equal diameters.

20. The method of claim 18 further including using gears for synchronizing said ink application roller, said smoothing cylinder, said screen roller and said forme cylinder.

21. The method of claim 18 further including providing said forme cylinder circumference being twice said ink application roller circumference and twice said smoothing cylinder circumference, said forme cylinder having two formes and two short inking units, said ink application roller and said smoothing cylinder of each said short inking unit contacting only their associated one of said two formes.

22. The method of claim 16 further including providing a plurality of said inking systems associated with said forme cylinder, and selecting a number of said plurality of inking systems equaling a whole number multiple which said forme cylinder circumference is in relation to said at least one ink application roller circumference.

23. The method of claim 16 further including providing said at least one ink application roller having an offset rubber blanket.

24. The method of claim 16 further including providing bearer rings for said ink application roller and said screen roller.

25. The method of claim 16 further including providing said ink application roller and said screen roller having bearer rings acting together in pairs.

26. The method of claim 16 further including providing a transfer cylinder acting with said forme cylinder.

27. The method of claim 26 including providing said transfer cylinder and said forme cylinder having bearer rings acting together in pairs and further providing said ink application roller and said screen rollers having bearer rings acting in pairs.

28. The method of claim 26 including providing said transfer cylinder and said forme cylinder having pretensioned roller bearings acting together in pairs and further providing said ink application roller and said screen roller having pretensioned roller bearings acting in pairs.

29. The method of claim 16 further including providing pretensioned rolling bearings for said ink application roller and said screen roller.

30. The method of claim 16 including providing said ink application roller and said screen roller having roller bearings acting together in pairs.

31. The method of claim 16 further including providing a functionally endless blanket on said at least one ink application roller.

32. The method of claim 16 further including providing a chamber doctor blade associated with said screen roller.

33. The method of claim 16 including providing a ratio of a screen on said screen roller to a ratio of a screen on a printing forme on said forme cylinder being greater than 0.8.

34. The method of claim 16 further including providing at least one additional inking roller in addition to said ink application roller as a smoothing cylinder.

35. The method of claim 34 further including supporting said smoothing cylinder for axial movement.

36. The method of claim 16 further including providing a plurality of inking systems to said forme cylinder and selecting said number of inking systems to equal a whole number multiple defined by a ratio of said forme cylinder circumference to said ink application roller circumference.

37. The method of claim 16 further including providing a transfer cylinder acting together with said forme cylinder.

38. The method of claim 37 further including pairs of bearing rings acting between said transfer cylinder and said forme cylinder and pairs of bearer rings acting between said ink application roller and said screen roller.

39. The method of claim 37 further including providing pairs of pretensioned roller bearings acting between said transfer cylinder and said forme cylinder and pairs of pretensioned roller bearings acting between said ink application roller and said screen roller.

40. The method of claim 16 further including providing pretensioned roller bearings for said ink application roller and said screen roller.

41. The method of claim 16 further including providing pretensioned roller bearings acting in pairs for said ink application roller and said other of said first and second inking rollers.

42. The method of claim 16 further including providing a pasty printing ink of a viscosity greater than 9000 mPa.s for use with said screen roller.

43. The method of claim 16 further including providing a ratio of a circumferential length per angular unit of said ink application roller in relation to an axial displacement per angular unit of said ink application roller being between 2.5 and 5.

44. A short inking system of a rotary printing press comprising:

a screen roller, said screen roller having a screen roller diameter and a screen roller circumference;

at least a first ink application roller in contact with said screen roller, said at least first ink application roller having a first ink application roller circumference and a first ink application roller diameter;

a forme cylinder which receives ink from said at least first ink application roller, said forme cylinder having a forme cylinder circumference;

means for driving said at least first ink application roller for rotation independently of said forme cylinder and in synchronization with said forme cylinder; and means for supporting said at least first ink application roller for axial displacement and wherein a ratio of a circumferential displacement per angular unit of movement of said axially displaceable first ink application roller to an axial displacement per angular unit of movement of said axially displaceable first ink application roller is between 2.5 and 5.

45. The short inking system of claim 44 further including a second ink application roller.

46. The short inking system of claim 45 wherein said second ink application roller is a smoothing cylinder supported for axial movement.

47. The short inking system of claim 46 wherein said forme cylinder, said ink application roller and said smoothing roller diameter are equal.

48. The short inking system of claim 46 wherein each said ink application roller, said smoothing cylinder, said screen roller and said forme cylinder are synchronized by gear wheels.

49. The short inking system of claim 46 wherein said forme cylinder circumference is twice said ink application roller circumference and twice said smoothing cylinder circumference, said forme cylinder having two formes and two short inking units, said ink application roller and said smoothing cylinder of each said short inking unit contacting only their associated one of said two formes.

50. The short inking system of claim 44 further including a plurality of inking systems associated with said forme cylinder, a number of said plurality of inking systems equaling the whole number multiple which said forme cylinder circumference is in relation to said at least first ink application roller circumference.

51. The short inking system of claim 44 wherein said first one ink application roller has an offset rubber blanket.

52. The short inking system of claim 44 further including bearer rings for said ink application roller and said screen roller.

53. The short inking system of claim 44 wherein said ink application roller and said screen roller have bearer rings acting together in pairs.

54. The short inking system of claim 44 further including a transfer cylinder acting with said forme cylinder.

55. The short inking system of claim 54 wherein said transfer cylinder and said forme cylinder have pretensioned roller bearings acting together in pairs and further wherein said ink application roller and said screen roller have pretensioned roller bearings acting in pairs.

56. The short inking system of claim 54 wherein said transfer cylinder and said forme cylinder have bearer rings acting together in pairs and further wherein said ink application roller and said screen rollers have bearer rings acting in pairs.

57. The short inking system of claim 44 further including pretensioned rolling bearings for said ink application roller and said screen roller.

58. The short inking system of claim 44 wherein said ink application roller and said screen roller have roller bearings acting together in pairs.

59. The short inking system of claim 44 further including a functionally endless blanket on said at least one ink application roller.

60. The short inking system of claim 44 further including a chamber doctor blade associated with said screen roller.

61. The short inking unit of claim 44 wherein a ratio of a screen on said screen roller to a ratio of a screen on a printing forme on said forme cylinder is greater than 0.8.

* * * * *